US008747045B2

(12) United States Patent
Belik

(10) Patent No.: US 8,747,045 B2
(45) Date of Patent: Jun. 10, 2014

(54) PIPE STABILIZER FOR PIPE SECTION GUIDE SYSTEM

(75) Inventor: Jaroslav Belik, Pearland, TX (US)

(73) Assignee: National Oilwell Varco, L.P., Houston, TX (US)

( * ) Notice: Subject to any disclaimer, the term of this patent is extended or adjusted under 35 U.S.C. 154(b) by 653 days.

(21) Appl. No.: 12/611,804

(22) Filed: Nov. 3, 2009

(65) Prior Publication Data

US 2011/0103922 A1 May 5, 2011

(51) Int. Cl.

| | |
|---|---|
| ***B23P 19/00*** | (2006.01) |
| ***B66C 1/06*** | (2006.01) |
| ***H01F 7/20*** | (2006.01) |
| ***E21B 19/14*** | (2006.01) |

(52) U.S. Cl.
USPC ..... 414/22.63; 294/65.5; 414/745.2; 901/40

(58) Field of Classification Search
USPC ..... 166/77.53, 85.1; 294/104, 106, 197, 294/198, 65.5, 86.13; 335/285, 286, 289, 335/291; 414/22.51–22.55, 22.57–22.59, 414/22.61, 22.63, 23, 606, 620, 621, 745.1, 414/745.2, 793.2, 797.1, 910, 919; 910/39, 910/40

See application file for complete search history.

(56) References Cited

U.S. PATENT DOCUMENTS

| | | | | |
|---|---|---|---|---|
| 2,730,246 | A * | 1/1956 | Stone | 414/22.71 |
| 3,373,881 | A * | 3/1968 | Frogge | 414/22.51 |
| 3,533,516 | A * | 10/1970 | Guier | 414/22.51 |
| 3,623,620 | A * | 11/1971 | Vermette | 414/420 |
| 3,840,128 | A * | 10/1974 | Swoboda et al. | 414/728 |
| 4,274,778 | A * | 6/1981 | Putnam et al. | 414/22.71 |
| 4,440,536 | A | 4/1984 | Scaggs | |
| 4,610,315 | A * | 9/1986 | Koga et al. | 175/85 |
| 4,643,624 | A * | 2/1987 | Murphree | 414/22.61 |
| 4,652,195 | A * | 3/1987 | McArthur | 414/22.51 |
| 4,715,637 | A * | 12/1987 | Hosoda et al. | 294/86.4 |
| 4,732,522 | A * | 3/1988 | Pence | 414/796.7 |
| 4,921,386 | A | 5/1990 | McArthur | |
| 5,116,386 | A * | 5/1992 | Scribner | 623/64 |
| 6,538,544 | B1 * | 3/2003 | Hardy | 335/285 |
| 6,550,128 | B1 | 4/2003 | Lorenz | |
| 6,591,471 | B1 | 7/2003 | Hollingsworth et al. | |
| 6,963,261 | B2 * | 11/2005 | Vicentelli | 335/288 |
| 7,140,455 | B2 | 11/2006 | Shahin et al. | |
| 7,178,612 | B2 | 2/2007 | Belik | |
| 7,188,686 | B2 | 3/2007 | Folk et al. | |
| 7,222,683 | B2 | 5/2007 | Folk et al. | |

(Continued)

FOREIGN PATENT DOCUMENTS

EP 1978205 A2 10/2008

OTHER PUBLICATIONS

International Application No. PCT/US2010/054511 Search Report and Written Opinion dated Jun. 10, 2011.

*Primary Examiner* — Gregory Adams
(74) *Attorney, Agent, or Firm* — Conley Rose, P.C.

(57) ABSTRACT

A pipe handling system includes a pipe stabilizer for receiving a pipe as lateral movement of the pipe is controlled by a guide system. The end portion of the pipe stabilizer may include a magnetic member configured to releasably couple to the pipe. The end portion of the pipe stabilizer may be extended and retracted by a rotatable arm. The end portion of the pipe stabilizer may be moved by an adjustment mechanism relative to another portion of the stabilizer or a drill string at well center for fine tuning placement of the pipe.

22 Claims, 20 Drawing Sheets

(56) References Cited

U.S. PATENT DOCUMENTS

| | | | |
|---|---|---|---|
| 7,228,913 | B2 | 6/2007 | Folk et al. |
| 7,249,639 | B2 | 7/2007 | Belik |
| 2003/0167623 | A1 | 9/2003 | Lorenz |
| 2007/0017703 | A1 | 1/2007 | Belik |
| 2009/0053014 | A1 | 2/2009 | Ge |

* cited by examiner

PIPE STABILIZER FOR PIPE SECTION GUIDE SYSTEM

BACKGROUND

The present disclosure relates generally to methods and apparatus for drilling earthen wells. More specifically, the present disclosure relates to systems for drilling earthen wells using joints of connectable pipe, and handling the pipe joints.

Drilling rigs require tubular members, such as drill pipe, drill collars, and casing, to be added or removed from the downhole tubular string in sections. The sections of tubular members may be stored in a setback area on or near the drilling rig. The sections of tubular members comprise three joints of pipe coupled together, for example, and the drilling rig is called a triple rig. In other examples, the pipe sections may comprise more or less pipe joints and the corresponding drilling rig may be called a quadruple rig, a double rig or a single rig. The tubular members may be stored vertically adjacent the rig, or horizontally away from the rig where they are transported to the rig and inclined toward the vertical position.

As the different tubular members are needed, they are brought to the drill floor one at a time and added to the string. Handling these tubular members has historically been a highly manual job using winches or other lifting appliances within the rig. Automated systems for use in drilling rigs must be able to safely handle a variety of tubular members while not slowing down drilling or tripping processes.

There are limitations and safety concerns with current pipe handling systems. Thus, there remains a need to develop methods and apparatus for pipe handling and drilling systems, which overcome some of the foregoing difficulties while providing more advantageous overall results.

SUMMARY

An embodiment of a pipe handling system includes a lifting mechanism configured to couple to an upper end of a pipe, a guide system operable to engage the pipe and control lateral movement of the pipe as it is moved between a storage position and a well center position, a pipe stabilizer including an end portion for receiving the pipe, and a magnetic member coupled to the stabilizer end portion and configured to releasably couple to the pipe. The magnetic member may be moveably retained at the stabilizer end portion. The pipe handling system may include a biasing spring coupling the magnetic member to the stabilizer end portion. The spring may allow movement of the magnetic member in response to pipe movement while retaining the magnetic member at the end portion. The pipe handling system may include an end portion adjustment mechanism, for fine tuning placement of the pipe relative to another portion of the pipe stabilizer or a drill string at the well center position. The pipe stabilizer may be extendably coupled to a rig structure. The pipe stabilizer may include a rotatable arm. The magnetic member may include a roller.

In some embodiments, the pipe handling system further includes an elevated drill floor of the rig structure, a pipe erector operable to move a pipe from a horizontal storage position to an inclined position where an upper end of the pipe is adjacent to the elevated drill floor, wherein in the inclined position, the pipe is at an angle between horizontal and vertical and the upper end of the pipe is offset from well center, and wherein the guide system is operable to engage the pipe and control lateral movement of the pipe toward well center as the pipe is moved from being supported in the inclined position by the pipe erector to a vertical position supported by the rig, and the pipe stabilizer is operable to position the magnetic member adjacent well center and stabilize the pipe by magnetically coupling the magnetic member to the pipe.

An embodiment of a pipe handling system includes a lifting mechanism configured to couple to an upper end of a pipe, a guide system operable to engage the pipe and control lateral movement of the pipe as it is moved between a storage position and a well center position, a rotatable arm pivotal to position a coupling head assembly adjacent the well center position, and wherein the coupling head assembly includes a spring biased magnetic coupling member. The pipe handling system may further include a roller disposed adjacent the magnetic coupling member. The magnetic coupling member may couple to a pipe to stabilize the pipe near the well center position. The magnetic coupling member may be moveable in response to pipe movement while the spring retains the magnetic coupling member in the head assembly.

An embodiment of a pipe handling system includes a lifting mechanism configured to couple to an upper end of a pipe, a guide system operable to engage the pipe and control lateral movement of the pipe as it is moved between a storage position and a well center position, a rotatable arm pivotal to position a coupling head assembly adjacent the well center position, and an adjustment mechanism coupled to the arm to further adjust the position of the coupling head assembly while the rotatable arm is fully extended. The pipe handling system may further include a flexibly retained magnetic member in the coupling head assembly to couple to the pipe. The pipe handling system may further include a hydraulically actuated clamping arm in the coupling head assembly to couple to the pipe.

An embodiment of a pipe handling method includes supporting an upper end of a pipe with a lifting mechanism, extending a pipe guide, engaging the pipe with the extended pipe guide to control lateral movement of the pipe, and further extending a magnet to couple to and stabilize the pipe during lateral movement. The method may include biasing the magnet with a spring. The method may include retaining the magnet with the spring while allowing movement of the magnet in response to pipe movement. The method may include rolling the magnet along the coupled pipe. The method may include adjusting the position of the extended magnet relative to a well center position or a work string.

Thus, the embodiments herein include a combination of features and advantages that enable substantial enhancement of moving pipe and other tubular members to and from a drilling rig. These and various other characteristics and advantages of the present disclosure will be readily apparent to those skilled in the art upon reading the following detailed description of the embodiments and by referring to the accompanying drawings.

BRIEF DESCRIPTION OF THE DRAWINGS

For a more detailed description of the embodiments of the disclosure, reference will now be made to the accompanying drawings, wherein.

DETAILED DESCRIPTION

Figure 1:
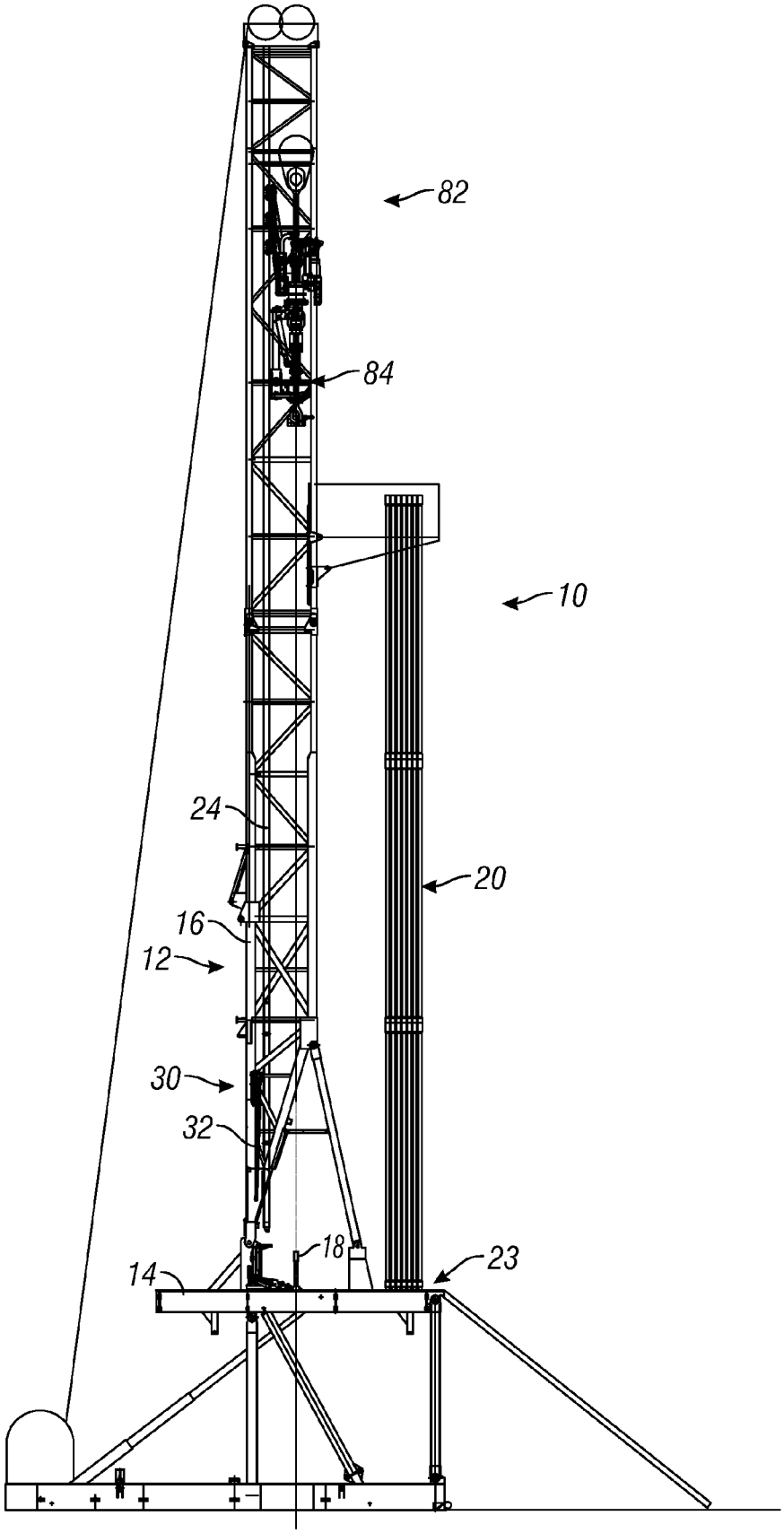
FIG. 1 is an elevation view of a drilling system including a pipe guide system.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. The use of pipe or drill pipe herein is understood to include casing, drill collar, and other oilfield and downhole tubulars. In the following discussion and in the claims, the terms "including" and "comprising" are used in an open-ended fashion, and thus should be interpreted to mean "including, but not limited to . . . ". The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a drilling system 10 includes a rig structure 12 having a drill floor 14 and a mast or derrick 16. A drill string 18 extends through the drill floor 14. A series of pipe joint sections 20 or other tubular members is set back from the drill string on the drill floor 14 in a storage area 23, waiting to be added to the drill string 18. In exemplary embodiments, the triple pipe joint sections 20 include three connected pipe joints. In other exemplary embodiments, the pipe joint sections include two or four pipe joints. The drill floor 14 may support other pipe handling systems for the drilling or tripping process as will be described herein, such as a stabbing system, slips, a pipe lubricator, a mud bucket and other systems used in making up or breaking out pipe joints.

The upper portion of the rig structure 16 supports a lifting and support mechanism such as a top drive system 82 including a pipe elevator 84. A torque tube 24 or other support structure extends downward from the top drive system 82. A pipe guide system may be provided to engage a pipe joint and control lateral movement of the pipe as it is moved between a storage position and a well center position. In exemplary embodiments, the pipe guide is a system 30 coupled to the tube 24, including extendable arms 32. Details of the pipe guide system 30 are presented elsewhere herein, and in PCT Application No. PCT/US09/58995 filed Sep. 30, 2009 and entitled Pipe Section Guide System with Flexible Member. Other pipe guide systems for supporting and controlling lateral movement of pipe are also contemplated.

Figure 2:
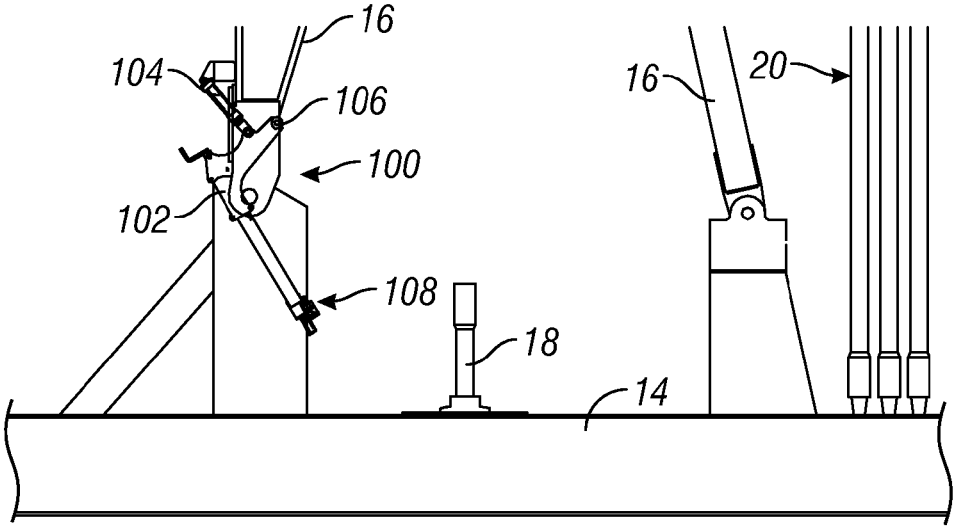
FIG. 2 is an enlarged side view of the drill floor of FIG. 1 also showing an embodiment of a pipe stabilizer in accordance with principles disclosed herein.
Figure 3:
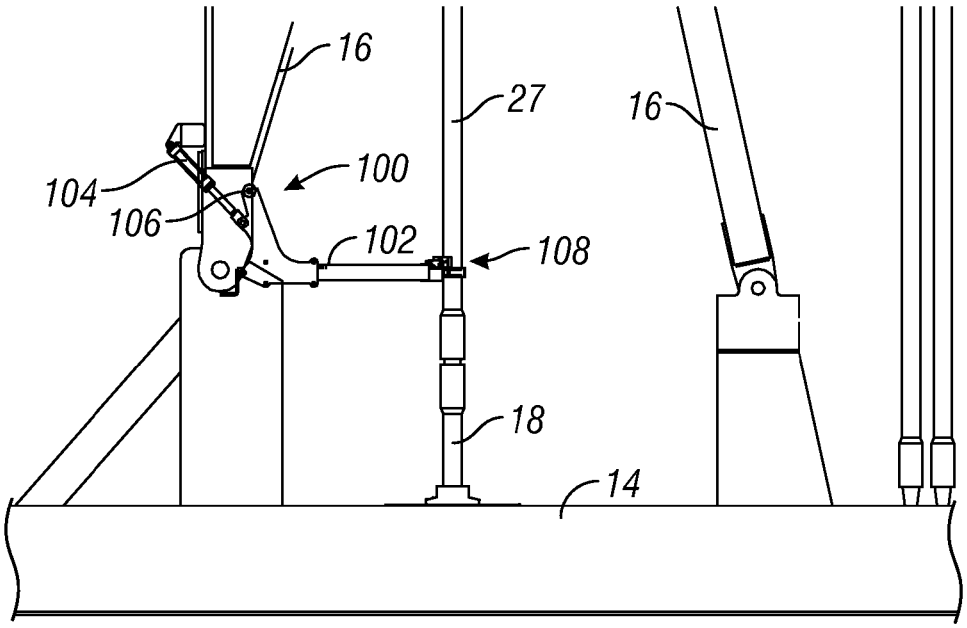
FIG. 3 is the pipe stabilizer of FIG. 2 with an arm fully extended toward a pipe positioned above a work string at well center.

For exemplary embodiments of a pipe stabilizer, reference is made to FIGS. 2 and 3. Coupled to the mast 16 is a pipe stabilizer 100. The stabilizer 100 includes a arm 102 rotatably coupled to the mast 16 at a pivot 106. The arm 102 includes an end portion or head 108 for coupling to a pipe section. The stabilizer 100 is shown in a retracted position relative to the drill string 18, rotated about its pivot 106 by retraction of the drive mechanism 104. The drive mechanism 104 may include a hydraulic piston and cylinder arrangement. As shown in FIG. 2, the stabilizer 100 is extendable by actuating the hydraulic cylinder 104 and rotating the arm 102 about the pivot 106. The coupling end 108 can then be engaged with a pipe section 27.

Figure 4:
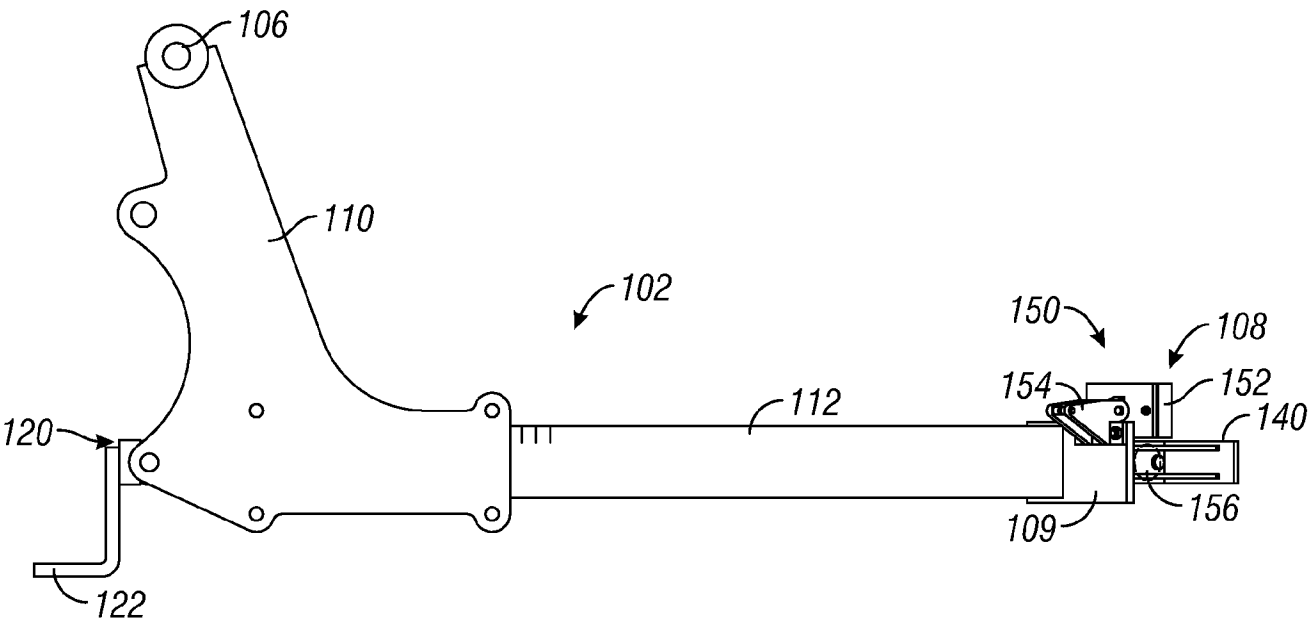
FIG. 4 is an enlarged side view of the pipe stabilizer of FIGS. 2 and 3.

Referring to FIG. 4, an embodiment of the moveable stabilizer member or arm 102 is shown in a side view. A base portion 110 includes the pivot coupling 106 and receives a moveable or adjustable portion 112. The end coupling portion 108 is disposed at an operating end of the adjustable portion 112. The base portion 110 also supports an adjustment mechanism 120 including a crank handle 122, which will be more fully explained below. The coupling end 108 includes several interacting structures and mechanisms for coupling to and stabilizing the pipe section 27.

Figure 5:
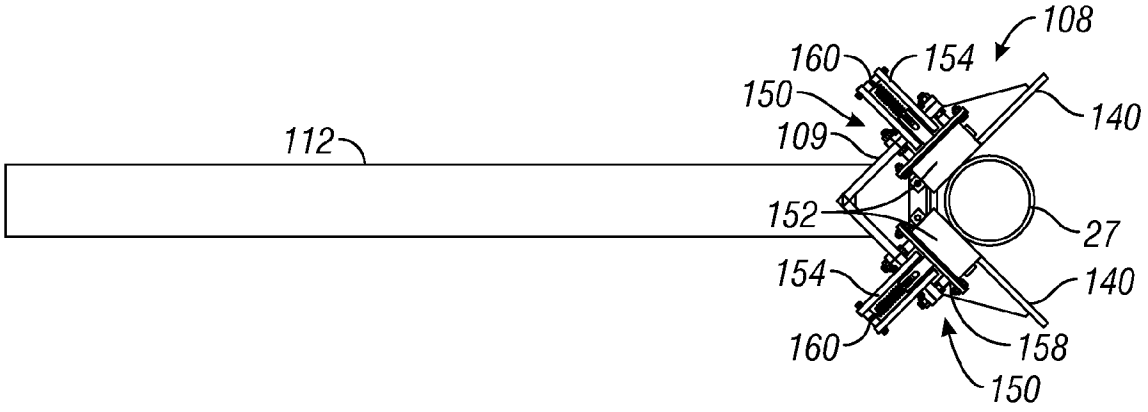
FIG. 5 is a top view of the pipe stabilizer of FIG. 4.

In the exemplary embodiment shown, the coupling end 108 includes one or more magnetic coupling assemblies 150. The assembly 150 includes a magnet 152 coupled to a support member 154 which is coupled to a support base 109. The support base 109 is supported by the adjustable arm portion 112. In some embodiments, the support base 109 is removable from the arm portion 112 so that the coupling assembly 108 can be removed or replaced by another coupling assembly. Disposed below the assembly 150 is a roller assembly 156. In some embodiments, the rollers 156 are plastic. The coupling assembly 108 also includes capture or guide plates 140 for contacting the pipe section 27 as shown in FIG. 5. In the top view of FIG. 5, two magnetic assemblies 150 are shown offset and angled relative to each other while facing the pipe section 27 for engagement. The magnets 152 are coupled to the support members 154, in part, by springs 160. The springs 160 provide a biasing and retention force for the magnets 152 while also providing flexibility of movement in response to actions from the pipe section 27. Coupled between the springs 160 and the magnets 152 are support plates 158.

Figure 6:
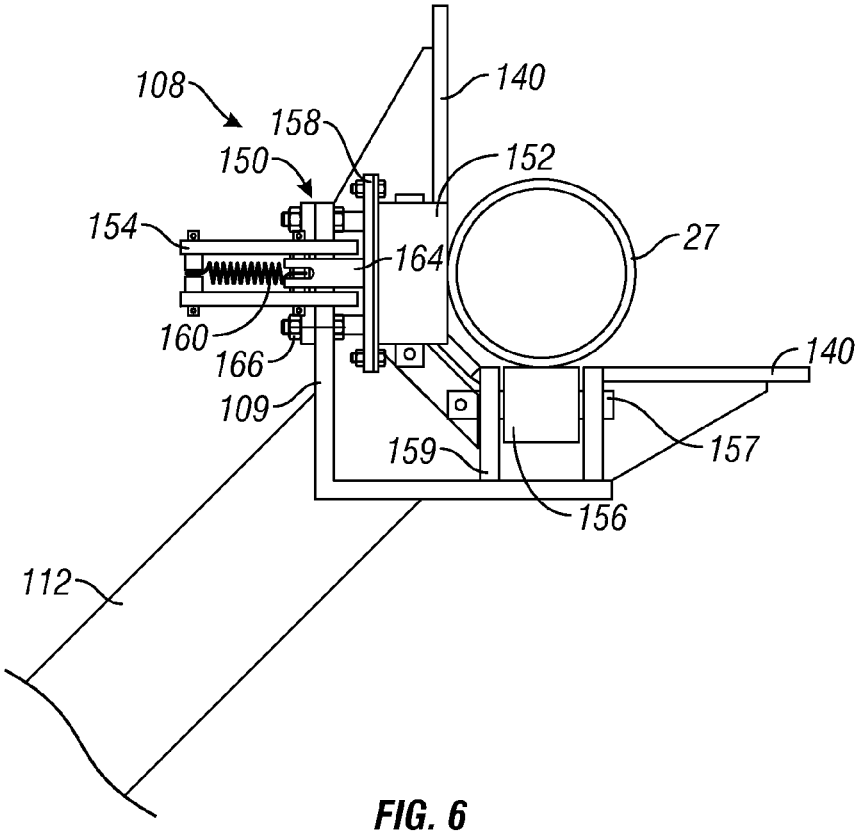
FIG. 6 is an enlarged top view of an embodiment of an end portion or coupling head assembly of the pipe stabilizer in accordance with principles disclosed herein.
Figure 7:
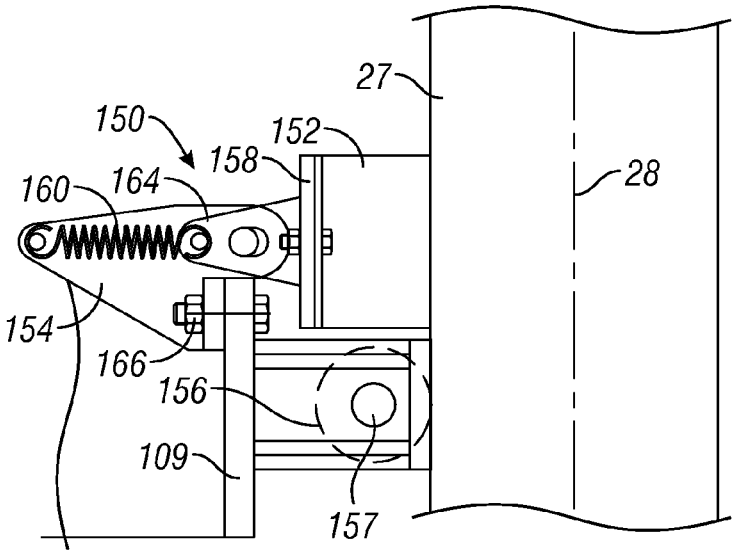
FIG. 7 is a side view of the coupling head assembly of FIG. 6.

Referring next to FIGS. 6 and 7, enlarged views of the coupling assembly 108 are shown for increased detail. In FIG. 6, the top view shows that the support member 154 is mounted to the support base 109 at the coupling 166. The spring 160 is coupled between the support member 154 and a support plate extension 164 to bias the magnet 152 to its ready position, but also to allow the magnet to move toward the pipe section 27, or up and down along the longitudinal pipe axis 28 (FIG. 7) to move with the pipe section 27 as it is being handled and stabilized. The second magnetic coupling assembly 150 is removed to reveal the roller 156, which is rotatably supported by support members 159 and a pin or axle 157 inserted through the support members and roller. As shown in FIG. 7, the magnet 152 magnetically couples to the pipe 27 when the pipe 27 is brought into proximity with the assembly 108. Because handling and stabilizing a pipe section is not always a smooth process, the movements associated therewith should be accommodated while maintaining the magnetic coupling between the arm and the pipe. The roller 156 provides a steadying guide for axial movement of the pipe section 27 while the spring 160 allows both radial and axial movement of the magnet 152 during magnetic attraction and coupling.

Figure 8:
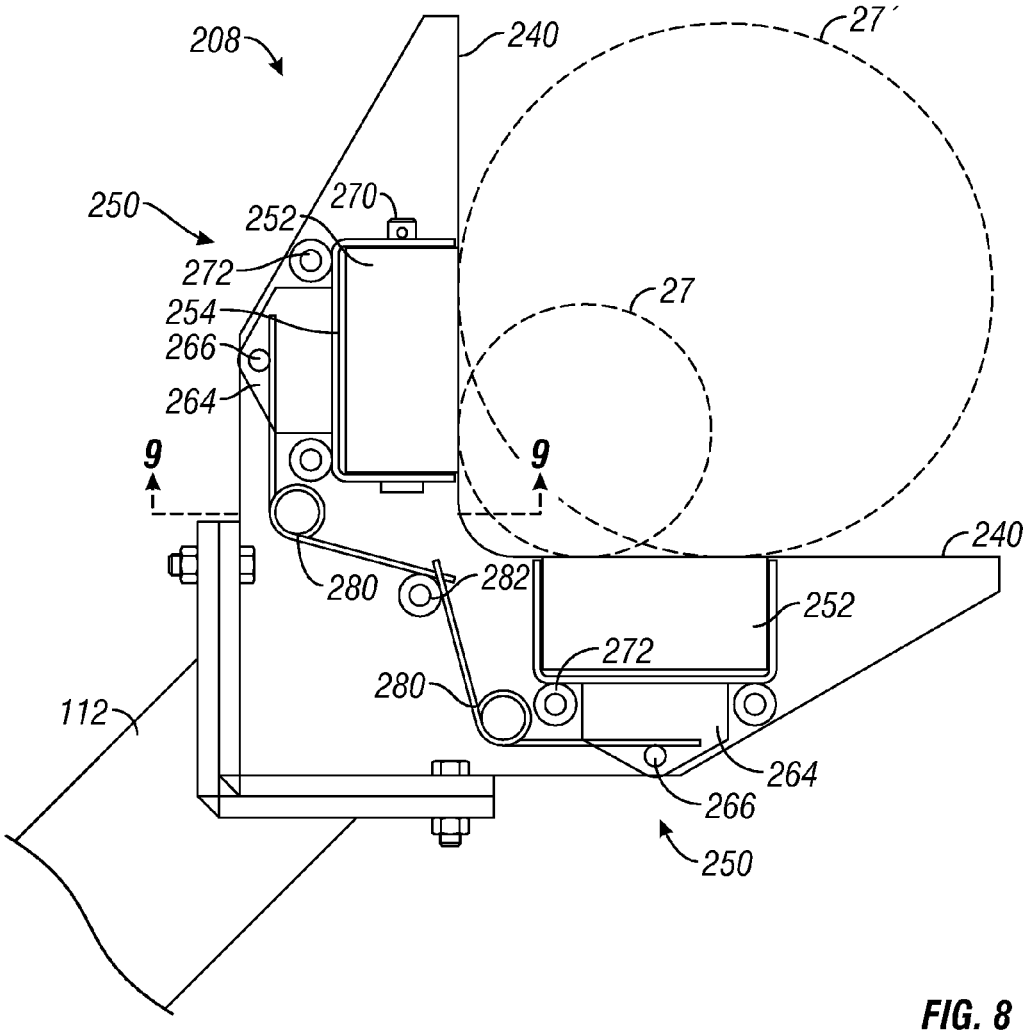
FIG. 8 is an enlarged top view of another embodiment of an end portion or coupling head assembly of the pipe stabilizer in accordance with principles disclosed herein.
Figure 9:
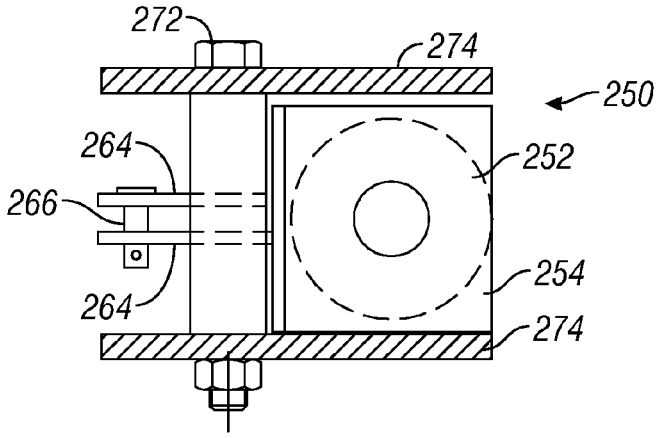
FIG. 9 is a cross-section view of FIG. 8 taken at section A-A.

Referring now to FIGS. 8 and 9, another embodiment of the magnetic coupling end of the stabilizer arm is shown. In the top view of FIG. 8, a coupling end assembly 208 includes one or more roller magnetic assemblies 250. Magnetic rollers 252 are rotatably mounted in support members 254 by pins or axles 270. Thus, axial movement of the pipe section 27 is accommodated by the rollers 252, which are magnetic to maintain the coupling with the pipe section 27 during movement. To provide the additional degree of freedom in response to pipe movement, the assemblies 250 also include biasing and retention springs 280. The springs 280 are coupled between a securing member or bolt 282 and extensions 264 of the support members 254. As shown in FIG. 9, a cross-section at A-A of FIG. 8, one end of the spring 280 reacts against a pin 266 coupled between upper and lower portions of the extension 264 while the other end of the spring 280 reacts against the bolt 282. The springs 280 are configured to provide a biasing force on the roller support member 254 away from the pipe 27, while also allowing flexibility of movement of the magnets 252 in response to movement of the pipe 27 in other directions and with forces that overcome the force of the spring. As also shown in FIG. 9, a bolt member 272 extends between upper and lower capture plates 274 to laterally retain the spring-biased support members 254.

As also shown in FIG. 8, different sizes 27, 27' of the pipe are engaged by the capture surfaces 240 while the rollers 252 also contact and couple to the different diameters of the smaller pipe 27 and the larger pipe 27'. Other various embodiments of the stabilizer arm coupling assemblies described herein also accommodate pipes of different diameters in this and other manners.

Figure 10:
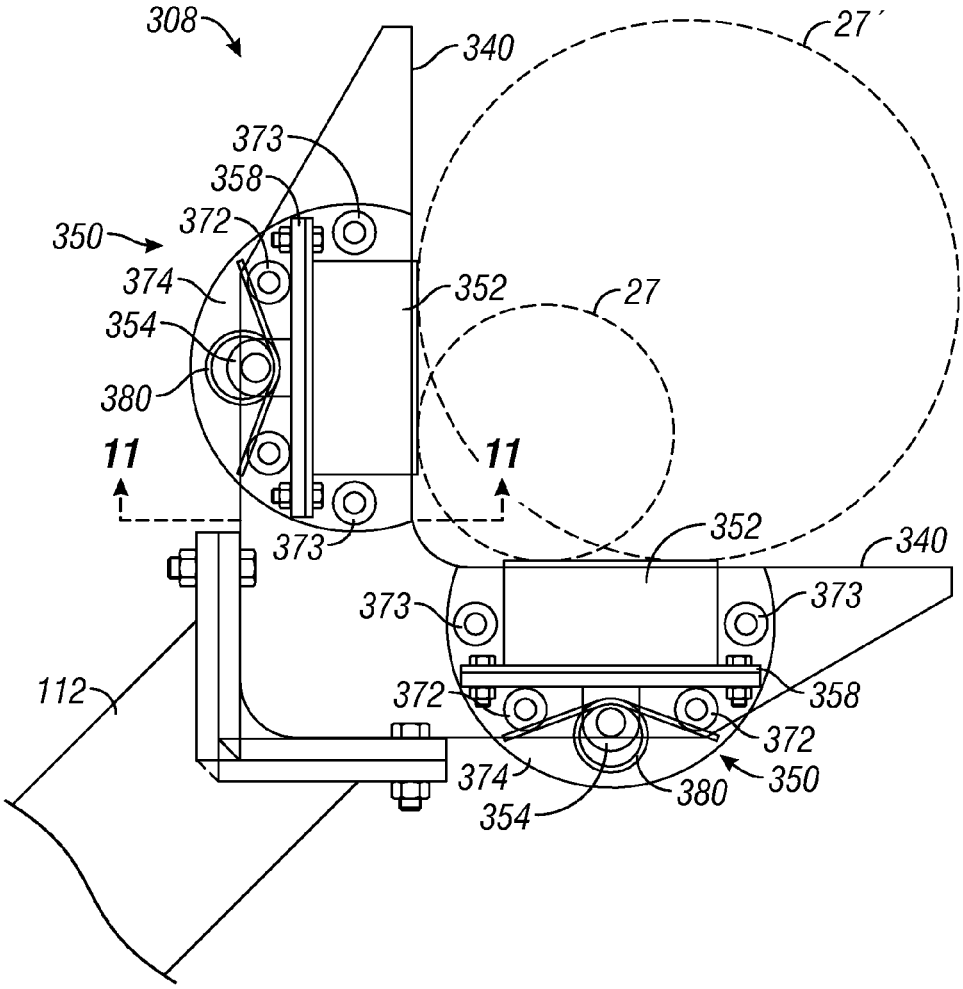
FIG. 10 is an enlarged top view of a further embodiment of an end portion or coupling head assembly of the pipe stabilizer in accordance with principles disclosed herein.
Figure 11:
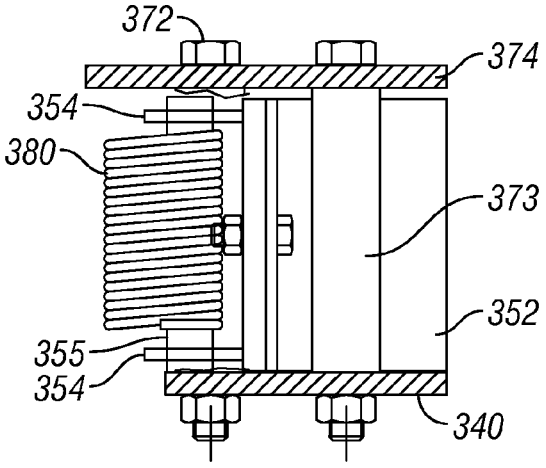
FIG. 11 is a cross-section view of FIG. 10 taken at section B-B.

Referring to FIGS. 10 and 11, a further embodiment of a coupling end or head assembly is shown. A coupling end assembly 308 includes magnet assemblies 350. In a further embodiment of the flexible magnet retention members, springs 380 react between retention members 372 and a retention member 355 (FIG. 11) to retain the magnet 352 in a biased position while also allowing flexibility of movement during engagement with the pipes 27, 27'. Magnets 352 coupled to support plates 358 are retained between an upper capture plate 374 and a lower capture plate 340, as well as laterally retained between the retention members 373. The springs 380 react against the retention members 372 to provide a retention force to the magnets 352 via a pin or bolt 355 extending through plate extensions 354 and the spring 380 (FIG. 11).

Figure 12:
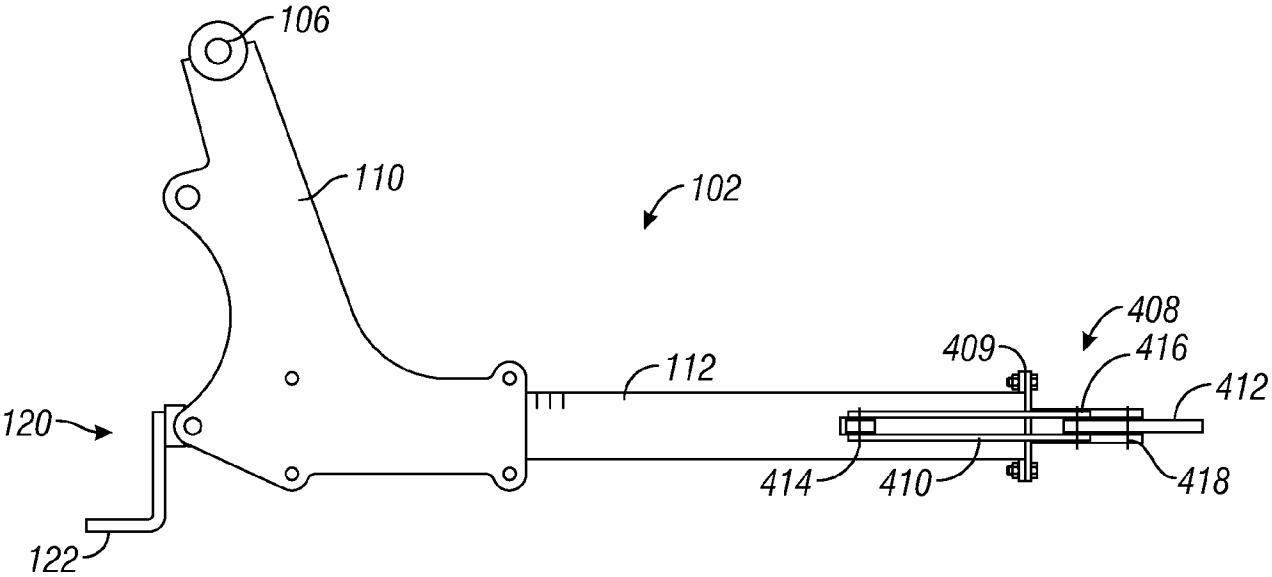
FIG. 12 is a side view of an alternative embodiment of a pipe stabilizer in accordance with principles disclosed herein, including a hydraulically actuated clamp.
Figure 13:
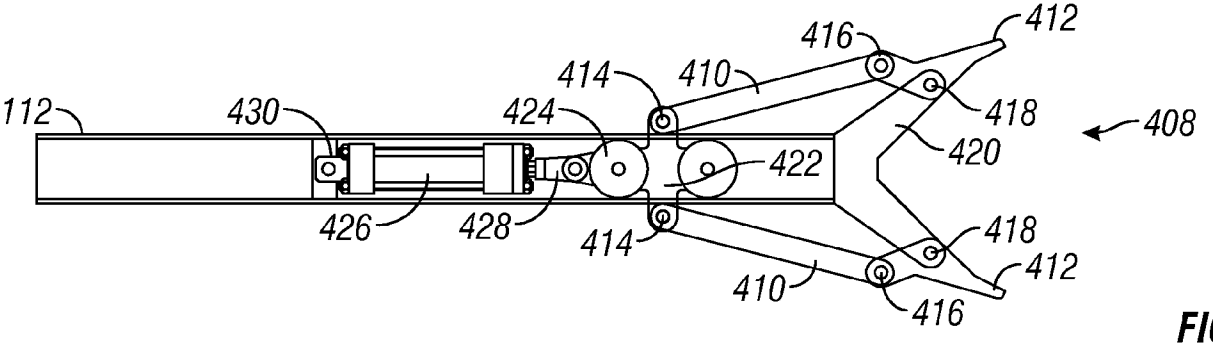
FIG. 13 is a top view of the pipe stabilizer of FIG. 12 in an open position.

Referring now to FIG. 12, some embodiments of the arm 102 include a mechanical coupling head assembly 408. The assembly 408 includes a pair of articulated arm assemblies having moveable members 410, 412 coupled together by a series of rotatable or pivotal couplings 414, 416, 418. The assembly 408 is coupled to the arm portion 112 that is adjustable in the base 110 as described herein. In the top view of FIG. 13, the top portion of arm 112 is cut away to reveal a drive mechanism for the articulated arms. A hydraulic cylinder 426 is mounted at 430 in the arm portion 112. A piston 428 is reciprocally disposed in the cylinder 426 for hydraulic movement. The piston 428 is coupled to a slidable drive member 422 having rollers 424. The drive member 422 includes rotatable couplings 414 coupled to arm members 410, which are rotatably coupled to clamping members 412 at 416. Rotatable couplings 418 also allow clamping members 412 to pivot at angled support or capture member 420 which is coupled to the adjustable arm portion at 409.

Figure 14:
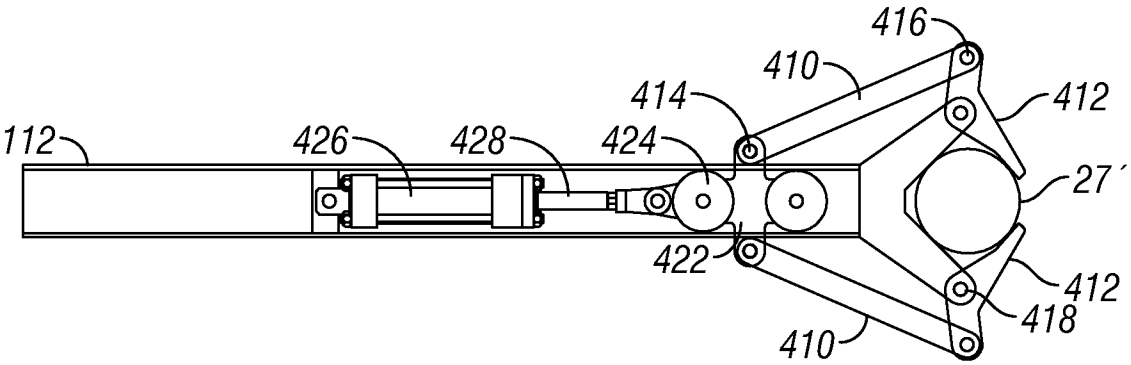
FIG. 14 is a top view of the pipe stabilizer of FIG. 12 in a closed position around a large diameter pipe.
Figure 15:
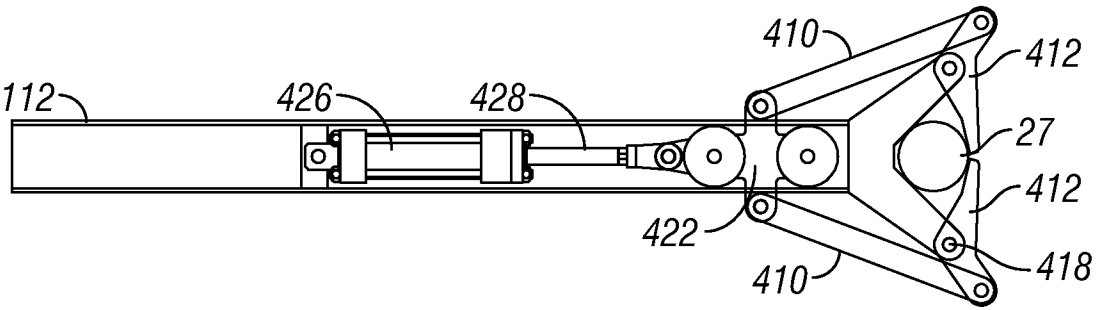
FIG. 15 is a top view of the pipe stabilizer of FIG. 12 in a closed position around and adjusted for a smaller diameter pipe.

As shown in FIG. 14, the cylinder 426 can be actuated to extend the piston 428 and slide the drive member 422 toward the pipe 27'. This action moves the arm members 410, causing the clamping members 412 to be rotated about the pivots 418 and clamp down on the pipe 27'. If the smaller diameter pipe section 27 is used, the cylinder 426 can extend the piston 428 further to drive the members 422, 410 and rotate the clamping members 412 onto to the pipe section 27.

Figure 16:
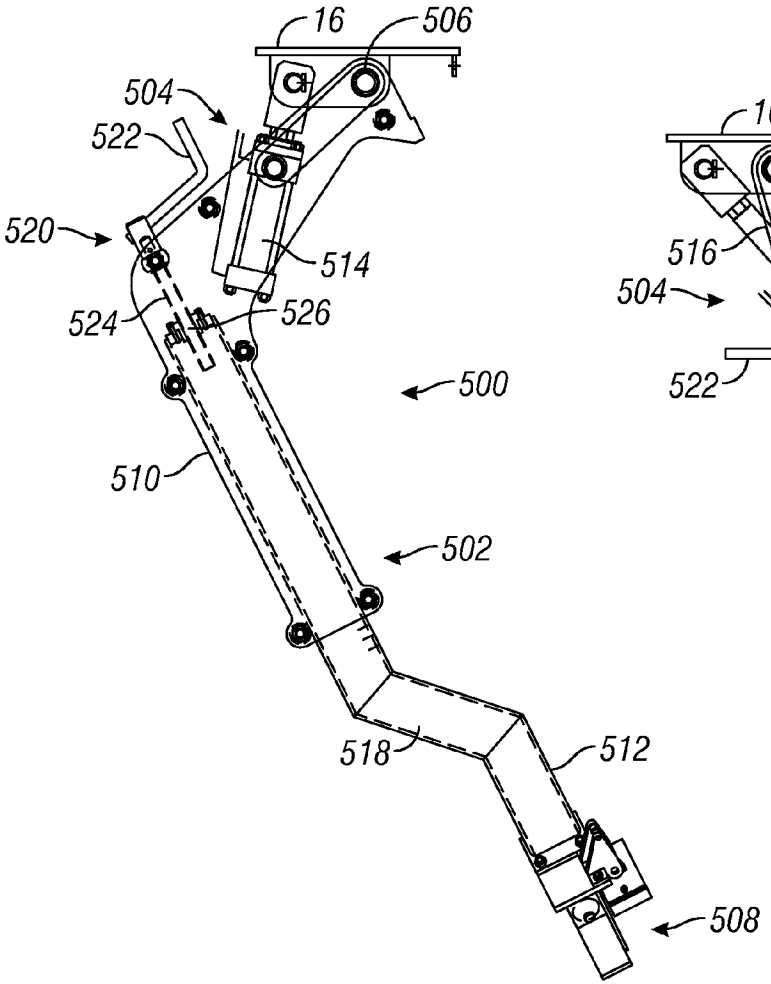
FIG. 16 is a side view of a further alternative embodiment of a pipe stabilizer in accordance with principles disclosed herein, shown in a retracted position.

As previously mentioned with respect to FIGS. 2 and 3, the stabilizer system 100 may include a retractable and extendable arm 102. The rotatably coupled arm 102 is pivotal by the drive mechanism 104. In some embodiments, and with reference to FIGS. 16 and 17, a stabilizer system 500 includes an arm 502 pivotally coupled at 506 and retractable to the position shown in FIG. 16 by a drive mechanism 504. The drive mechanism 504 includes a hydraulic cylinder 514, other known powered actuators. The drive mechanism is rotatably coupled between a portion of the rig structure 16 and a base portion 510 of the arm 502. The base portion 510 receives an adjustable arm portion 512 that includes an angled intermediate portion 518 and a coupling head assembly 508. The coupling head assembly 508 may include any of the coupling head embodiments described herein. An adjustment mechanism 520 includes a crank handle 522 with a threaded rod 524 coupled to a threaded nut 526 on the adjustable arm portion 512.

Figure 17:
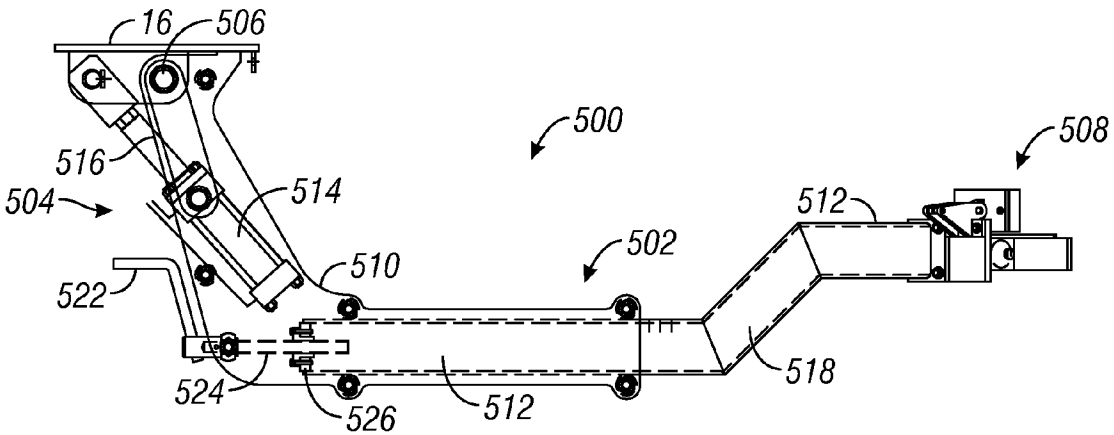
FIG. 17 is the pipe stabilizer of FIG. 16 in a fully extended position.

Referring now to FIG. 17, the hydraulic cylinder 514 can be actuated to extend a piston 516 and rotate the arm 502 about the pivot 506. This extends the coupling head 508 toward the tubing string at well center. If the coupling head 508 is misaligned with well center, such as at drill string 18, the handle 522 can be rotated to threadably extend or retract the arm portion 512 and adjust the position of the coupling head 508. Thus, the drive mechanism 520 provides a finer adjustment of the lateral position of the coupling head 508 than would be provided by the rotating drive mechanism 504 alone. In some embodiments, the arm 502 and the coupling head 508 are adjusted without pipe contact. In other embodiments, a pipe section is engaged with the coupling head 508 and the adjustment mechanism 520 is used to align the pipe section 27 with the drill string 18 for proper stabbing of the pipe section into the drill string.

Figure 19:
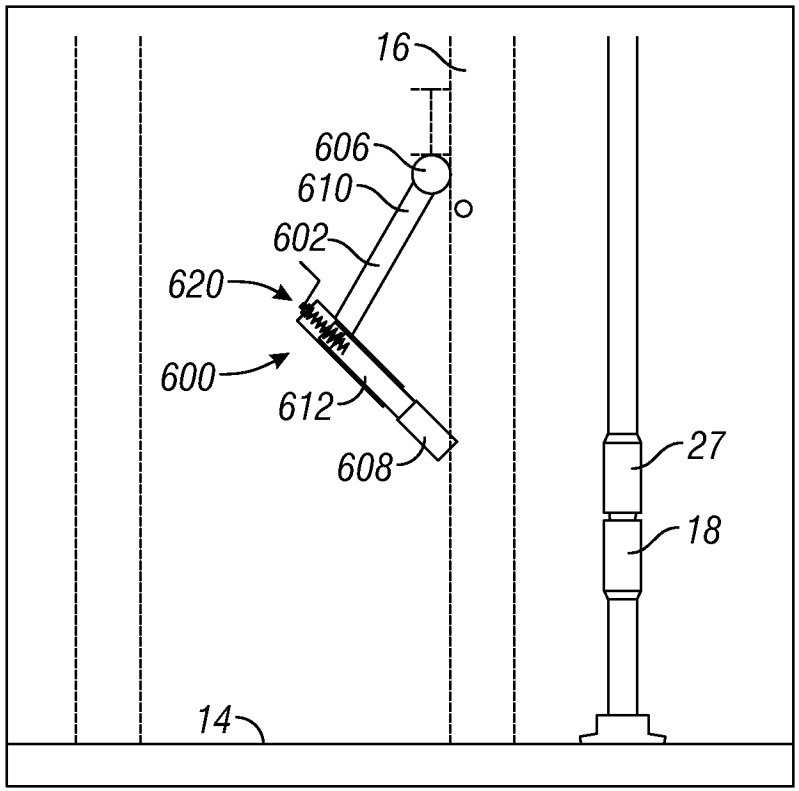
FIGS. 18 and 19 are schematic side views of a pipe stabilizer coupled to an alternative location on the rig and pivotal to extend and retract.
Figure 18:
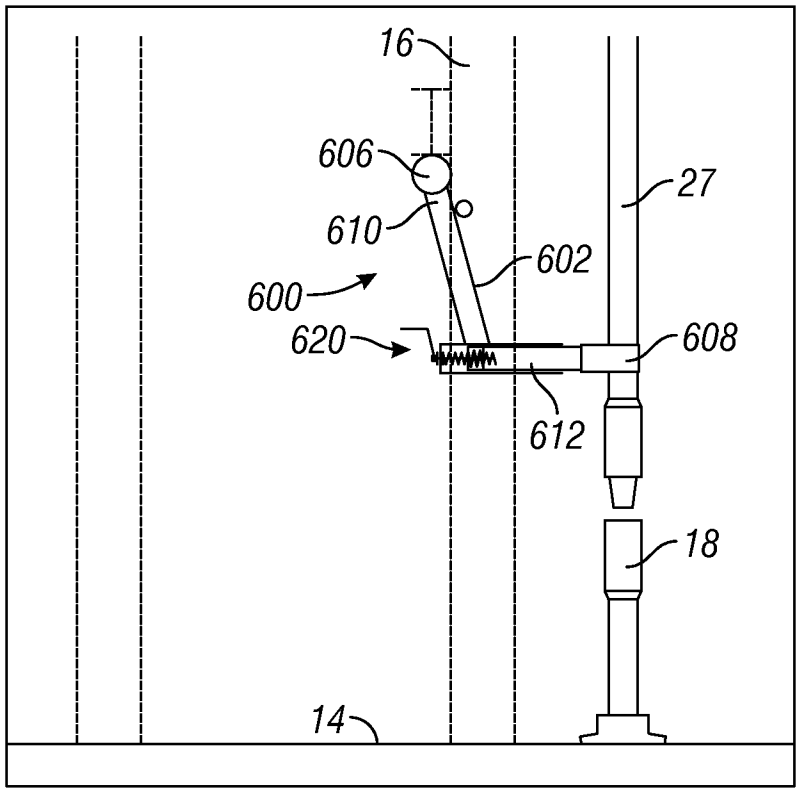

In some embodiments, the stabilizer arm system may be coupled into other portions of the rig structure and extendable at other angles. For example, with reference to FIG. 18, a system 600 includes an arm 602 extendable at pivot 606 to couple a head 608 with the pipe section 27. An arm base 610 supports an adjustment mechanism 620 that adjusts the position of an arm portion 612 to align the pipe section 27 for stabbing into pipe string 18. As shown in FIG. 19, the pipe section 27 is moved axially to stab it into the pipe string 18 with assistance from the rollers and/or flexibly retained magnets of the coupling head 608 as described herein. The head assembly 608 is then decoupled from the pipe section 27 and the arm 602 is retracted about the pivot 606 away from the made up pipe section.

Figure 21:
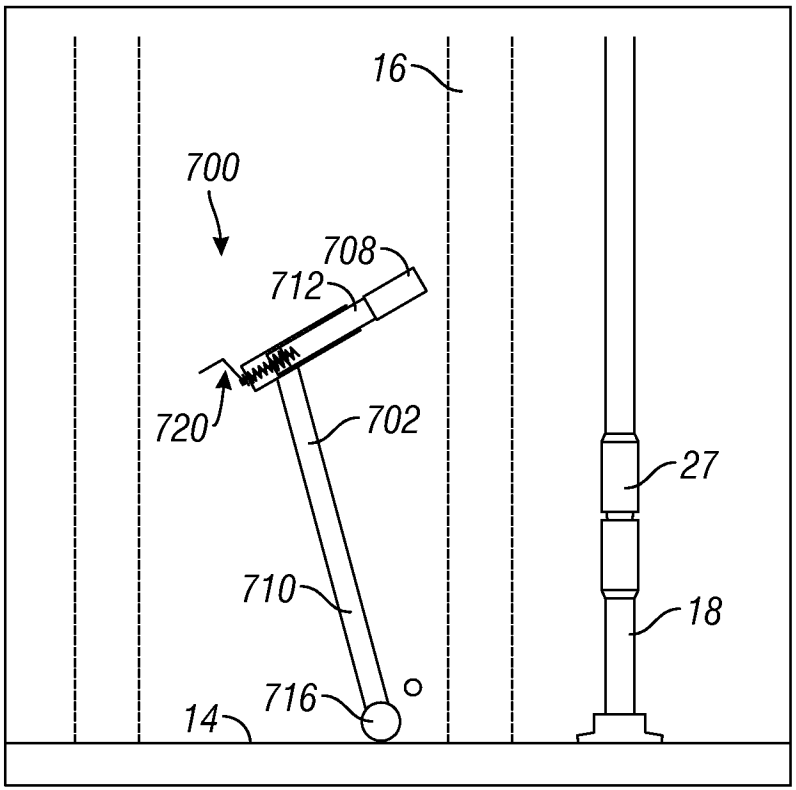
FIGS. 20 and 21 are schematic side views of a pipe stabilizer coupled to another alternative location on the rig and pivotal to extend and retract.
Figure 20:
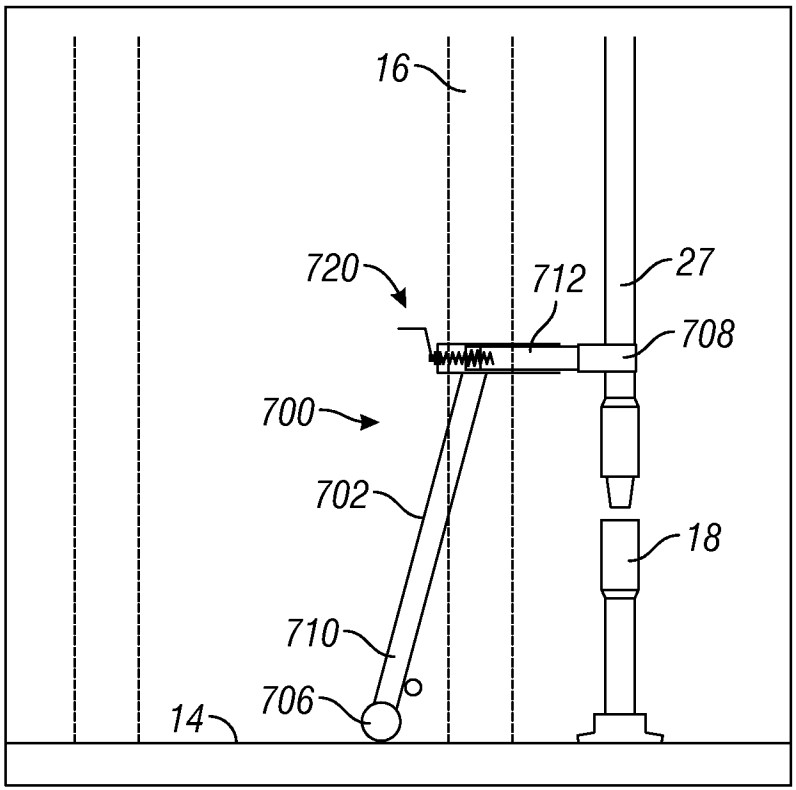

In other embodiments, and with reference to FIG. 20, a stabilizer arm system 700 is coupled at the rig floor 14. An arm 702 is extendable at pivot 706 to couple a head 708 with the pipe section 27. An arm base 710 supports an adjustment mechanism 720 that adjusts the position of an arm portion 712 to align the pipe section 27 for stabbing into pipe string 18. As shown in FIG. 21, the pipe section 27 is moved axially to stab it into the pipe string 18 with assistance from the rollers and/or flexibly retained magnets of the coupling head 708 as described herein. The head assembly 708 is then decoupled from the pipe section 27 and the arm 702 is retracted about the pivot 706 away from the made up pipe section.

Figure 23:
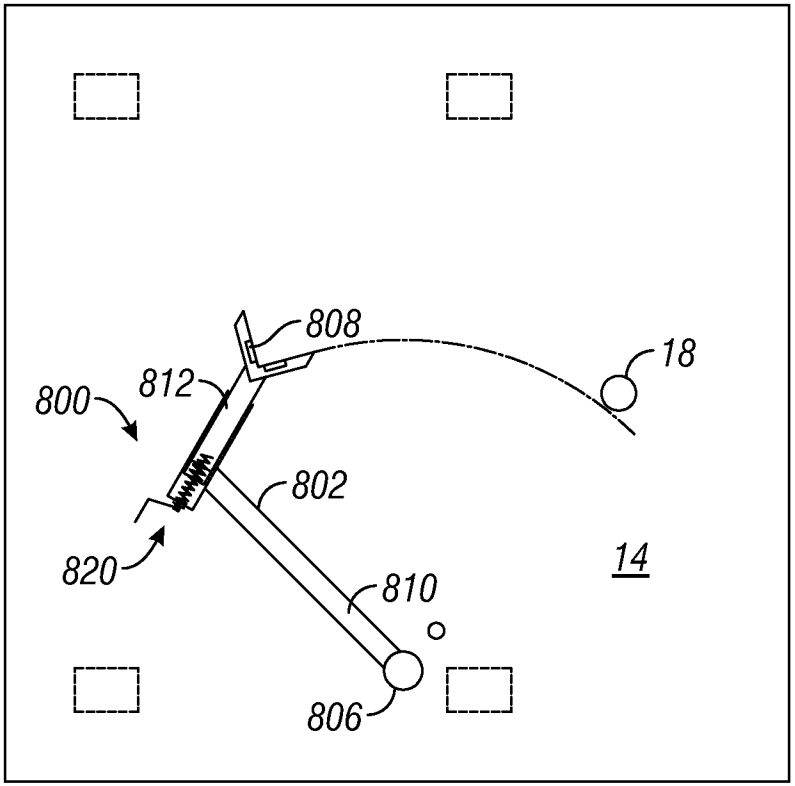
FIGS. 22 and 23 are schematic side views of a pipe stabilizer coupled to a further alternative location on the rig and pivotal to extend and retract.
Figure 22:
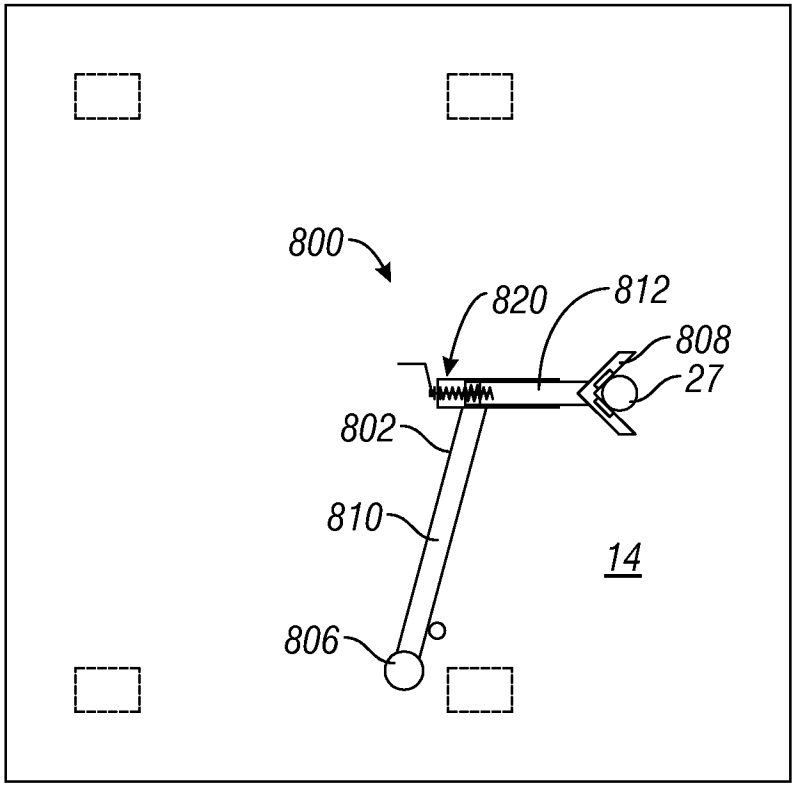

In still further embodiments, and with reference to FIG. 22, a stabilizer arm system 800 is coupled to the rig structure in a horizontal, rather than vertical, plane above the rig floor 14. An arm 802 is extendable at pivot 806 in a horizontal plane to couple a head 808 with the pipe section 27. An arm base 810 supports an adjustment mechanism 820 that adjusts the position of an arm portion 812 to align the pipe section 27 for stabbing into pipe string 18. As shown in FIG. 23, the head assembly 808 is decoupled from the made up pipe string 18 and the arm 802 is rotated about the pivot 806 to move the arm system away from the made up pipe string.

Figure 24:
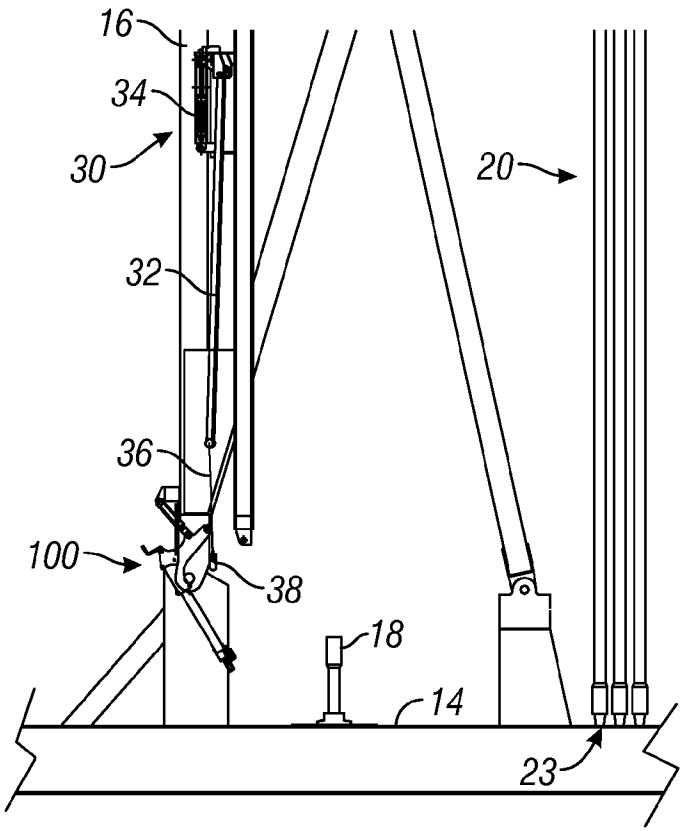

In operation, the pipe stabilizer systems described herein provide an automated means for handling and stabilizing pipe joint sections and other oilfield tubulars while they are moved into and out of position above a pipe string at well center. Referring now to FIGS. 1 and 24, different stages of operation for the pipe stabilizer system 100 are illustrated. It is understood that various other embodiments as described herein may be used in a similar manner, such as stabilizer systems 500, 600, 700, 800 and coupling head assemblies 208, 308, 408. In FIGS. 1 and 24, a group of triple joint sections 20 is stored in a setback or storage area 23 waiting to be made up with the drill string 18. The stabilizer system 100 and the pipe guide system 30 are in retracted positions. As previously noted, the pipe guide system may be any known system for guiding pipes, such as the Pipe Section Guide System with Flexible Member in PCT Application No. PCT/US09/58995 filed Sep. 30, 2009. The drive mechanism 34 of the pipe guide system 30 is disengaged to allow the arms 32, the cable 36, and the roller assembly 38 to hang in a downward position.

Figure 25:
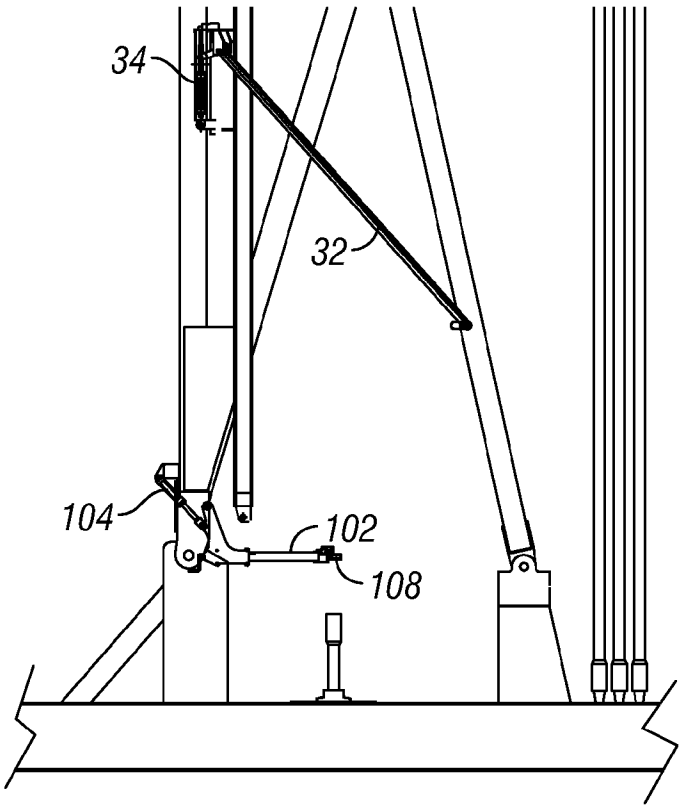
FIGS. 24-31 illustrate an operating process for lifting, guiding, and stabilizing a pipe for make up and tripping using the drilling systems and components described herein.
Figure 27:
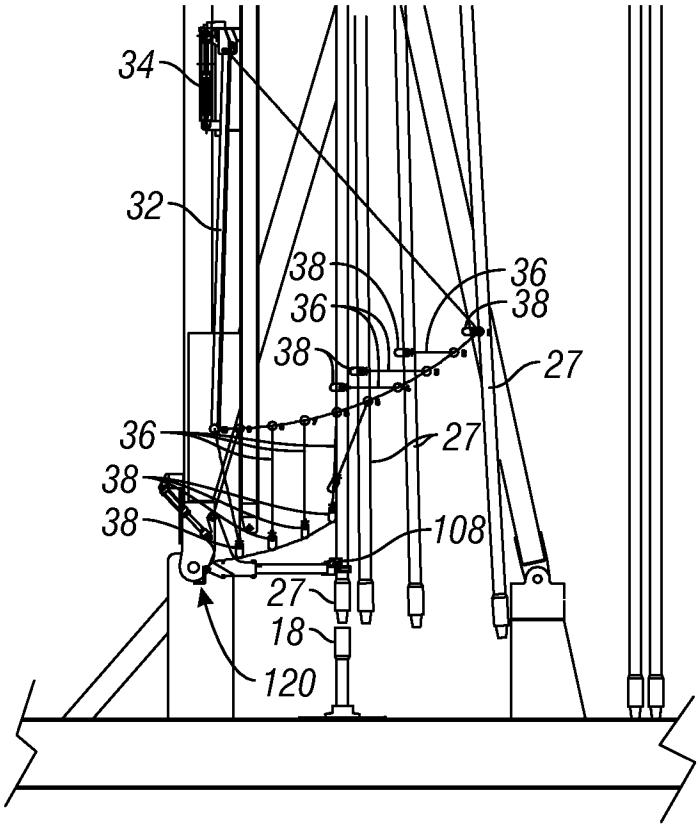
Figure 26:
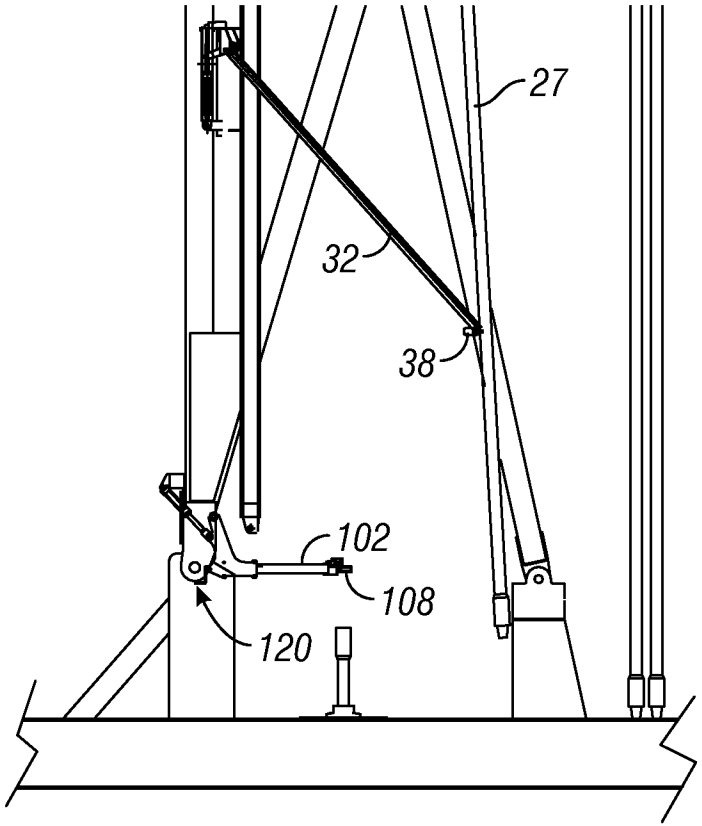
Figure 28:
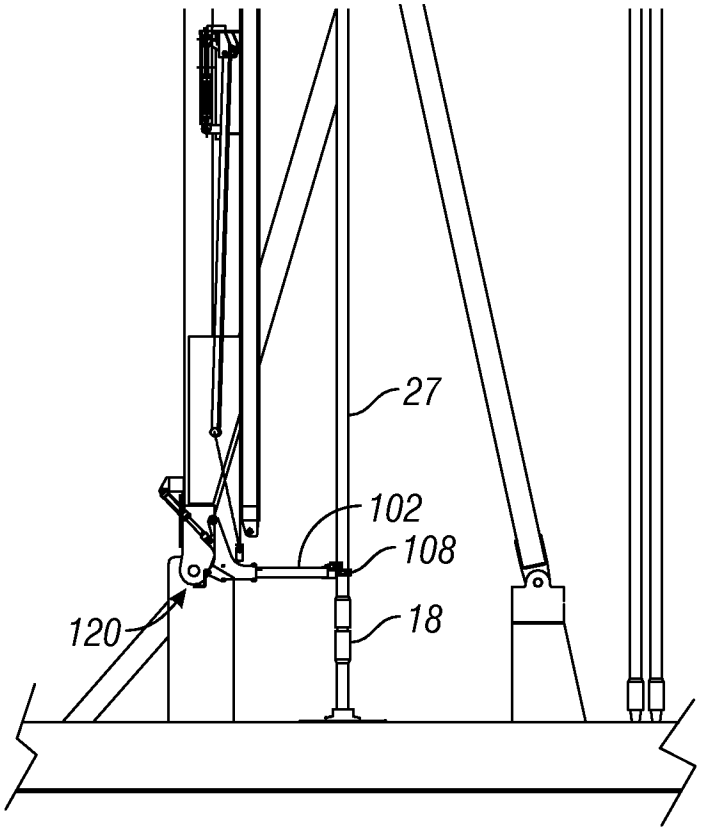

Referring next to FIG. 25, the stabilizer system arm 102 is extended as shown by the cylinder 104. The pipe guide system arms 32 are extended as shown by the drive mechanism 34. In FIG. 26, the pipe section 27 is picked up by a pipe elevator of a top drive assembly and moved laterally toward well center into engagement with the roller assembly 38 of the extended pipe guide arms 32. As shown in FIG. 27, the pipe guide system 30 engages or catches the pipe section 27 as it swings toward well center. The pipe section 27 is gathered and stabilized by the roller assembly 38. Then, the drive mechanism 34 is actuated to provide a controlled retraction of the guide arms 32 such that the roller assembly slides down the pipe section 27 and the cable 36 slackens to a hanging position, as shown by the range of positions in FIG. 27. The controlled retraction of the guide system 30 brings the pipe section 27 into engagement with the coupling assembly 108 of the stabilizer arm 102 near well center above the drill string 18. The coupling assembly 108 couples to the pipe section 27 magnetically or mechanically according the various embodiments described herein. At this time, the horizontal or lateral position of the pipe section 27 can be adjusted relative to the pipe string 18 using the adjustment mechanism 120. When properly aligned in this manner, the pipe section 27 can then be stabbed into the pipe string 18 as shown in FIG. 28.

Figure 29:
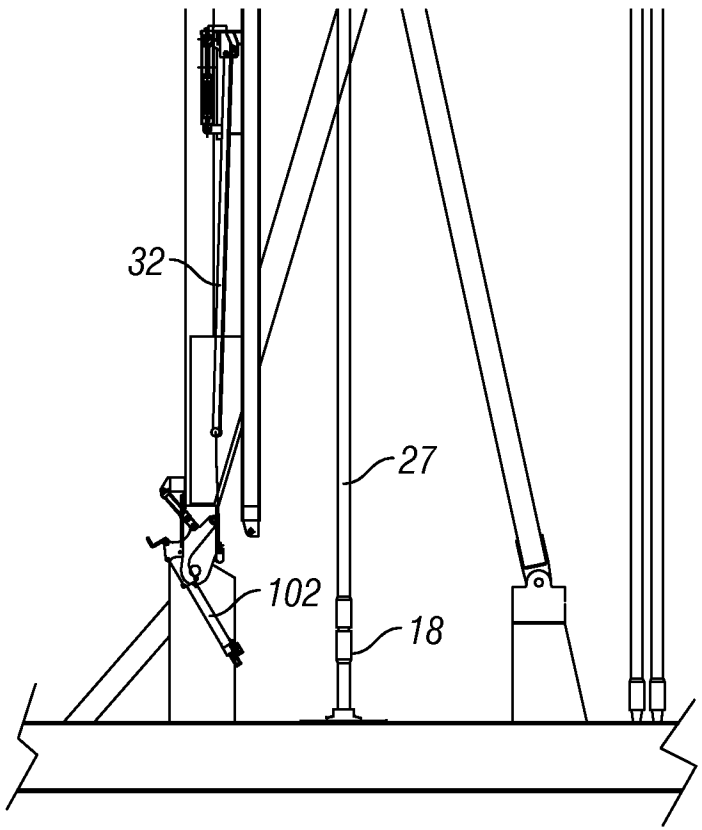
Figure 31:
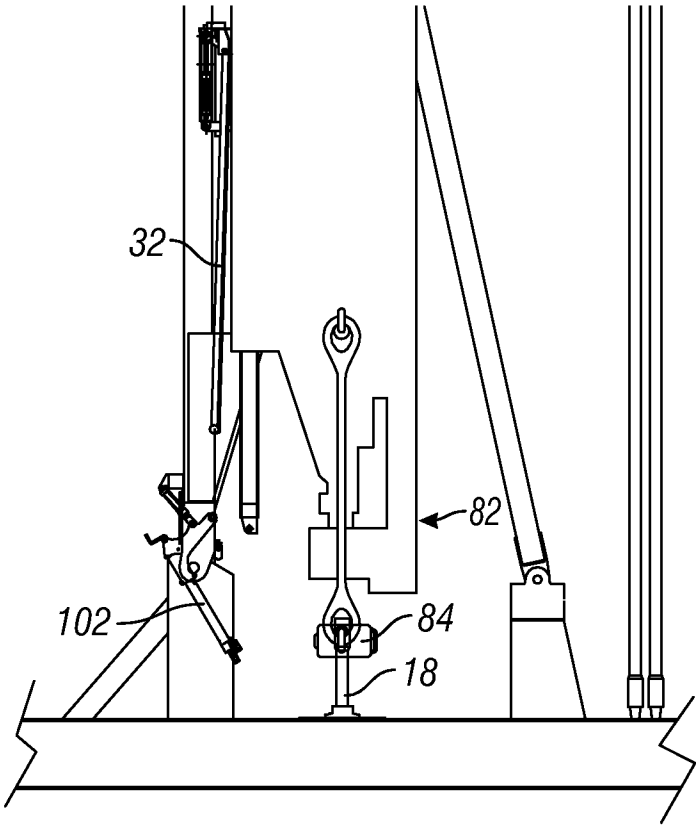
Figure 30:
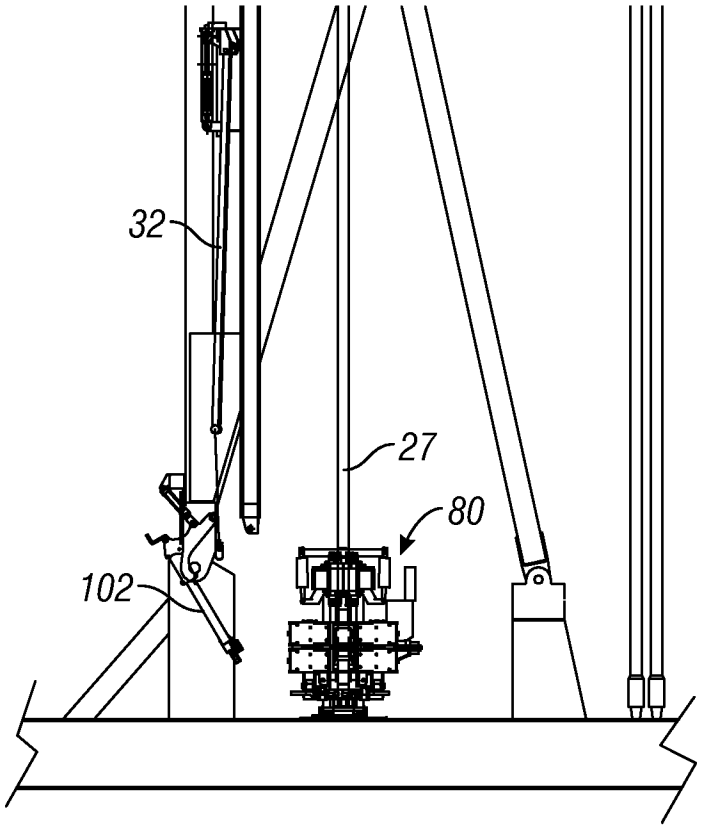

Referring to FIG. 29, the stabilizer arm 102 can be retracted as shown. Next, an iron roughneck 80 can be moved into the position shown in FIG. 30 for applying torque to the pipe section 27 and making it up with the pipe string 18. Finally, as illustrated in FIG. 31, the top drive 82 with elevator 84 moves the pipe string 18 down for drilling or other downhole operation to a position where it can receive another pipe section.

Various combinations of the steps just described are also used to perform additional operations. For example, a reverse order of the steps generally described with reference to FIGS. 24-31 may be executed during a tripping out process. The extension of the stabilizer arm 102 may be used to stabilize a pipe and the extension of the pipe guide arms 30 may be used to push a tripped out pipe section back toward the storage setback area 23.

Figure 32:
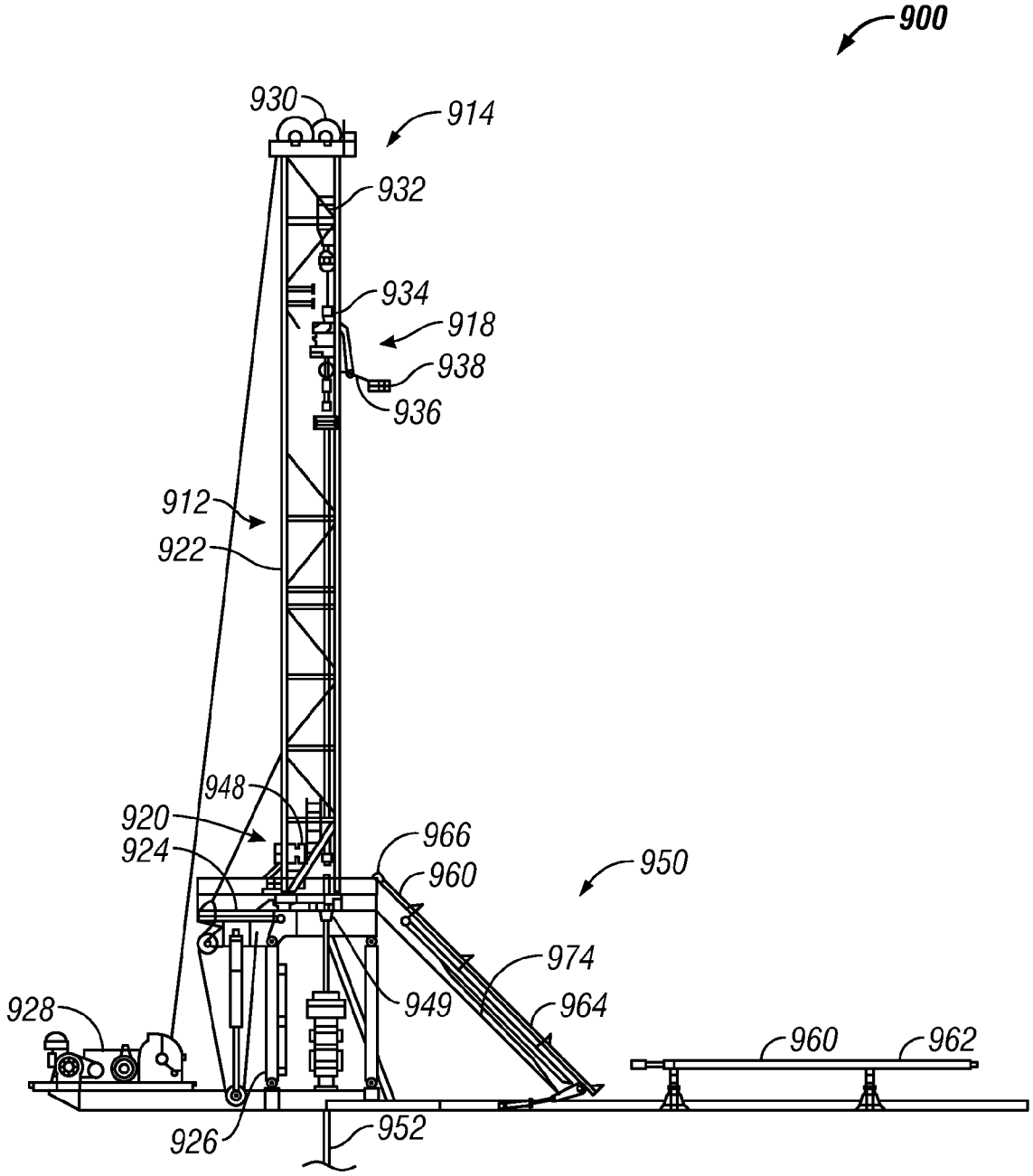
FIG. 32 is an elevation view of an exemplary drilling system with a pipe erector.

Referring now to FIG. 32, some embodiments of the drilling system with the pipe stabilizers as described herein may include a pipe erector and other components. A drilling system 900 comprises a rig structure 912, a hoisting system 914, a pipe erector system 950, a top drive system 918, and drill floor equipment 920. The rig structure 912 comprises a mast 922, an elevated drill floor 924, and a sub-structure 926. The hoisting system 914 comprises drawworks 928, a crown block 930, and a traveling block 932. The top drive system 918 comprises a top drive 934, bails 936, and an elevator 938. The drill floor equipment 920 comprises an iron roughneck system 948 and slips 949 that are located on well center 952. The pipe erector system 950 moves the drill pipe 960 from a horizontal storage position 962 to an inclined position 964 where the upper end 966 of the drill pipe is substantially adjacent to the elevated drill floor 924.

Figure 33:
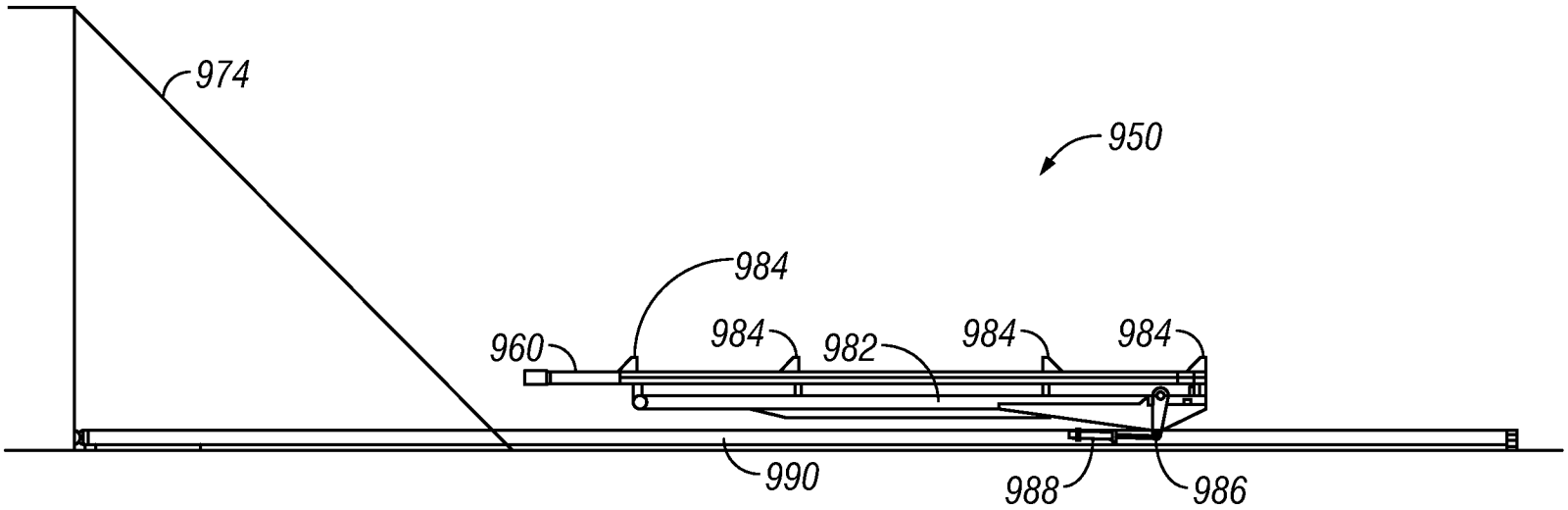
FIGS. 33-35 are enlarged views of the pipe erector moving a pipe section from a horizontal position to an inclined position toward the rig structure.
Figure 34:
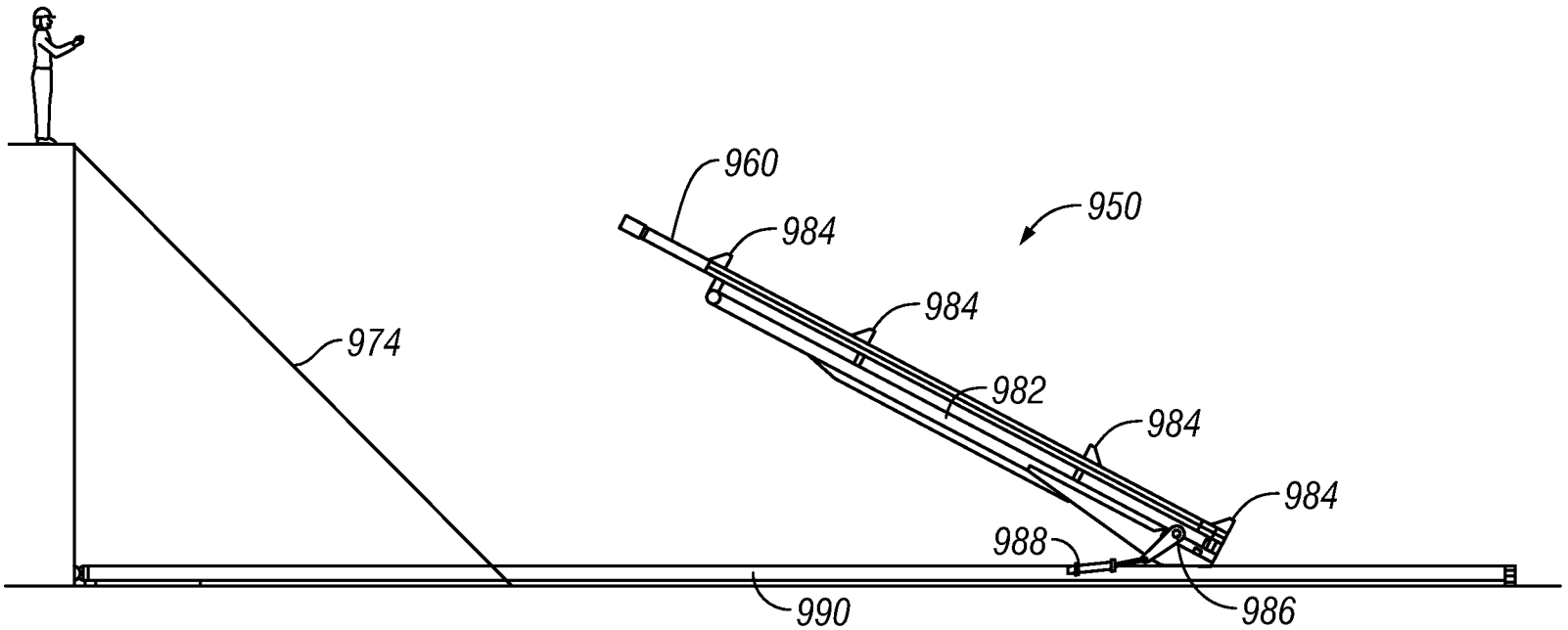
Figure 35:
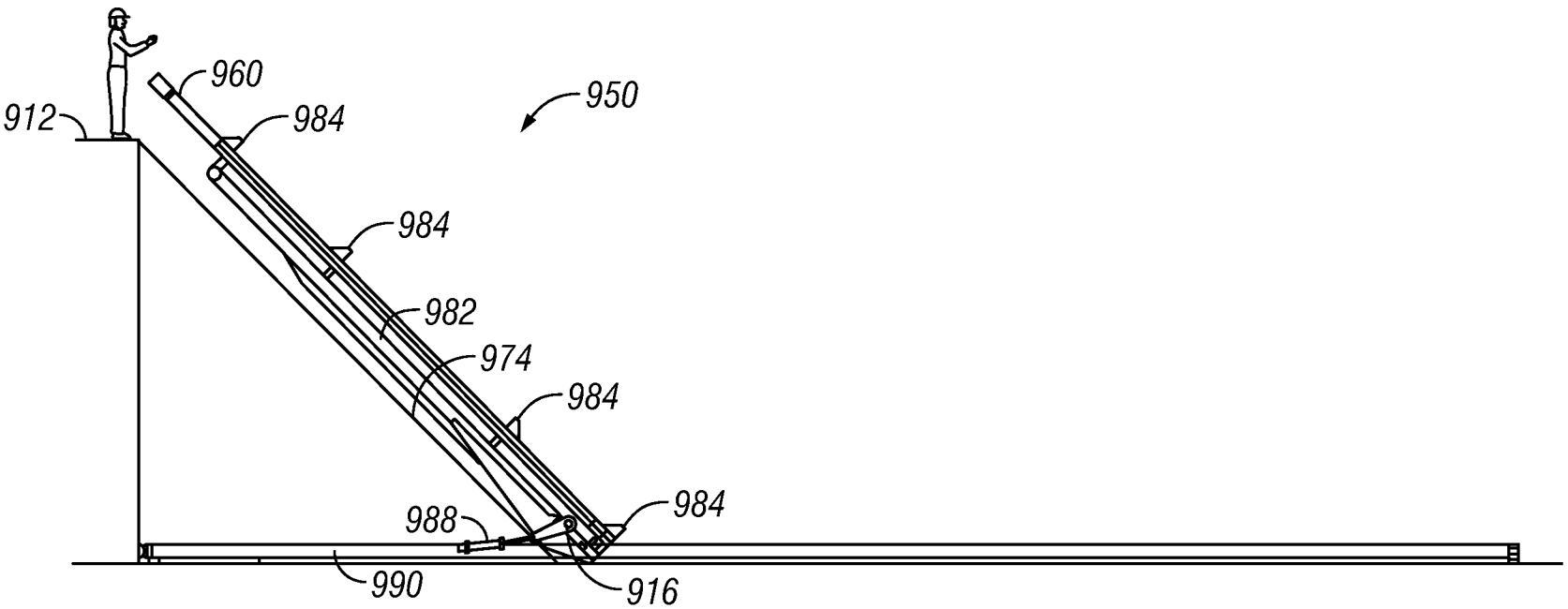

Referring to FIGS. 33-35, the erector system 950 comprises an erector frame 982, pipe guides 984, a pivot 986, an elevating cylinder 988, and a rail 990. The erector system 950 is utilized to elevate a pipe 960 from horizontal, as in FIG. 33, and move the pipe to a ramp 974 of the rig 912. The pipe 960 is received by pipe guides 984 mounted on the frame 982. The elevating cylinder 988 elevates the frame 982 to an angle so that the axis of the pipe 960 is substantially parallel to the ramp 974, as illustrated in FIG. 34. The frame 982 is then moved along the rail 990 until the pipe 960 is adjacent to the ramp 974, as illustrated in FIG. 35. Once on the ramp 974, the elevator 918, or some other lifting mechanism can engage the pipe 960 and lift the pipe into the rig 912.

When the pipe 960 is lifted into the rig 912 from the angled ramp 974, as previously noted, it may be desirable to control the lateral movement of the lower end of the pipe 960 so that the pipe does not swing dangerously once lifted from the ramp 974. Thus, the various embodiments of a pipe guide system and a pipe stabilizer as disclosed herein may be attached to the mast 922, or other drill floor equipment, and operated as described herein to control, guide and stabilize the pipe 960 to well center 952.

While certain embodiments of the disclosed principles have been shown and described, modifications thereof can be made by one skilled in the art without departing from the scope or teaching of this disclosure. The embodiments described herein are exemplary only and are not limiting. Accordingly, the scope of protection is not limited to the embodiments described herein, but is only limited by the claims that follow, the scope of which shall include all equivalents of the subject matter of the claims.

What is claimed is:

1. A pipe handling system comprising:

a lifting mechanism configured to couple to an upper end of a pipe;

a guide system operable to engage the pipe and control lateral movement of the pipe as it is moved between a storage position and a well center position;

a pipe stabilizer including an end portion for receiving the pipe;

a magnetic member coupled to the stabilizer end portion and configured to releasably couple to the pipe; and a torsional spring coupled between the stabilizer end portion and the magnetic member such that the magnetic member is moveably retained at and relative to the stabilizer end portion, and the magnetic member is biased in a first direction toward the stabilizer end portion such that the magnetic member receives the pipe in the first direction toward the stabilizer end portion and resists movement of the pipe in a second direction from the stabilizer end portion while being coupled to the pipe;

wherein the torsional spring has a longitudinal axis disposed at an angle offset from the first direction.

2. The pipe handling system of claim 1 wherein the spring allows movement of the magnetic member in response to pipe movement while retaining the magnetic member at the end portion.

3. The pipe handling system of claim 1 wherein the pipe stabilizer further includes an end portion adjustment mechanism.

4. The pipe handling system of claim 3 wherein the adjustment mechanism is configured to move the end portion relative to a drill string.

5. The pipe handling system of claim 4 wherein the adjustment mechanism is configured to move the pipe relative to a drill string when the pipe is releasably coupled to the magnetic member.

6. The pipe handling system of claim 1 wherein the pipe stabilizer is extendably coupled to a rig structure.

7. The pipe handling system of claim 6 wherein the pipe stabilizer is extendable toward the pipe and retractable away from the pipe.

8. The pipe handling system of claim 7 wherein the pipe stabilizer comprises a rotatable arm.

9. The pipe handling system of claim 8 wherein the rotatable arm is pivotably coupled to a rig structure.

10. The pipe handling system of claim 8 wherein the rotatable arm comprises an adjustment mechanism configured to further extend the end portion relative to another portion of the arm.

11. The pipe handling system of claim 3 wherein the adjustment mechanism comprises a crank handle and a rod threadably coupled to a nut.

12. The pipe handling system of claim 1 further comprising:

an elevated drill floor of the rig structure;

a pipe erector operable to move a pipe from a horizontal storage position to an inclined position where an upper end of the pipe is adjacent to the elevated drill floor, wherein in the inclined position, the pipe is at an angle between horizontal and vertical and the upper end of the pipe is offset from well center; and wherein the guide system is operable to engage the pipe and control lateral movement of the pipe toward well center as the pipe is moved from being supported in the inclined position by the pipe erector to a vertical position supported by the rig, and the pipe stabilizer is operable to position the magnetic member adjacent well center and stabilize the pipe by magnetically coupling the magnetic member to the pipe.

13. A pipe handling system comprising:

a lifting mechanism configured to couple to an upper end of a pipe;

a guide system operable to engage the pipe and control lateral movement of the pipe as it is moved between a storage position and a well center position;

a rotatable arm pivotal to position a coupling head assembly adjacent the well center position; and wherein the coupling head assembly includes a spring biased magnetic coupling member, wherein the spring biases the magnetic coupling member in a first direction into the head assembly and resists movement of the magnetic coupling member away from the head assembly in response to pipe movement;

wherein the spring is a torsional spring having a longitudinal axis disposed at an angle offset from the first direction.

14. The pipe handling system of claim 13 further including a roller disposed adjacent the magnetic coupling member.

15. The pipe handing system of claim 13 wherein the magnetic coupling member couples to a pipe to stabilize the pipe near the well center position.

16. The pipe handling system of claim 15 wherein the magnetic coupling member is moveable in response to pipe movement while the spring retains the magnetic coupling member in the head assembly.

17. The pipe handling system of claim 15 further comprising an adjustment mechanism in the arm to further adjust the position of the pipe to well center.

18. A pipe handling system comprising:

a lifting mechanism configured to couple to an upper end of a pipe;

a guide system operable to engage the pipe and control lateral movement of the pipe as it is moved between a storage position and a well center position;

a rotatable arm pivotal to position a coupling head assembly adjacent the well center position;

an adjustment mechanism coupled to the arm to further adjust the position of the coupling head assembly while the rotatable arm is fully extended;

a flexibly retained magnetic member biased in a first direction toward the coupling head assembly to couple to the pipe and resist movement of the pipe away from the coupling head assembly; and a biasing spring coupled between the coupling head assembly and the magnetic member, the biasing spring including a longitudinal axis disposed at an angle offset from the first direction.

19. The pipe handling system of claim 18 wherein the magnetic member is disposed in the coupling head assembly.

20. A pipe handling method comprising:

supporting an upper end of a pipe with a lifting mechanism;

extending a pipe guide;

engaging the pipe with the extended pipe guide to control lateral movement of the pipe;

extending a magnet with a pipe stabilizer;

biasing the magnet toward the pipe stabilizer using a torsional spring having a longitudinal axis;

coupling the magnet to the pipe; and resisting lateral movement of the pipe in a first direction away from the pipe stabilizer using the biased magnet; wherein the longitudinal axis of the torsional spring is disposed at an angle offset from the first direction.

21. The method of claim 20 further comprising retaining the magnet with the spring while allowing movement of the magnet in response to the lateral pipe movement.

22. The method of claim 20 further comprising adjusting the position of the extended magnet relative to a well center position or a work string.

* * * * *